US009241378B2

(12) United States Patent
Lee et al.

(10) Patent No.: US 9,241,378 B2
(45) Date of Patent: Jan. 19, 2016

(54) HYBRID CONSTANT CURRENT LED LAMP

(71) Applicant: Yu-Lin Lee, New Taipei (TW)

(72) Inventors: Yu-Lin Lee, New Taipei (TW); Kuo-Chung Huang, Taoyuan County (TW)

(73) Assignee: Yu-Lin Lee, New Taipei (TW)

( * ) Notice: Subject to any disclaimer, the term of this patent is extended or adjusted under 35 U.S.C. 154(b) by 0 days.

(21) Appl. No.: 14/205,782

(22) Filed: Mar. 12, 2014

(65) Prior Publication Data

US 2015/0002039 A1 Jan. 1, 2015

(30) Foreign Application Priority Data

Jun. 27, 2013 (TW) ..... 102212052 A

(51) Int. Cl.
*H05B 37/02* (2006.01)
*H05B 33/08* (2006.01)

(52) U.S. Cl.
CPC ..... *H05B 33/0815* (2013.01); *H05B 37/02* (2013.01)

(58) Field of Classification Search
CPC ..... H05B 37/02; H05B 37/03
USPC ..... 315/186, 187, 193, 200 R, 224, 294
See application file for complete search history.

(56) References Cited

U.S. PATENT DOCUMENTS

| | | | | |
|---|---|---|---|---|
| 8,519,631 | B2 | 8/2013 | Lee | |
| 2011/0080102 | A1* | 4/2011 | Ge et al. | 315/200 R |
| 2012/0181941 | A1* | 7/2012 | Kimura et al. | 315/200 R |
| 2013/0162157 | A1* | 6/2013 | Suzuki et al. | 315/201 |
| 2014/0285748 | A1* | 9/2014 | Zhang | 349/61 |
| 2014/0339991 | A1* | 11/2014 | Zhang | G09G 3/36 315/186 |

FOREIGN PATENT DOCUMENTS

| | | | |
|---|---|---|---|
| JP | 2004-303612 | A | 10/2004 |
| JP | 2006-040584 | A | 9/2006 |
| JP | 2012-105529 | A | 5/2012 |

* cited by examiner

*Primary Examiner* — Tung X Le
(74) *Attorney, Agent, or Firm* — Jackson IPG PLLC; Demian K. Jackson

(57) ABSTRACT

The present invention relates to a hybrid constant current LED lamp. The LED lamp includes a rectifier unit, a filter circuit, a switching mode power supply, at least one main LED and a subsidiary LED. The main LED is electrically connected in series to the output terminal of the rectifier unit and the input port of the primary-side circuit of the switching mode power supply. The subsidiary LED is connected to the secondary-side circuit. The invention not only provides circuit architecture capable of providing a constant current, but also improves the power efficiency of the lamp.

9 Claims, 4 Drawing Sheets

HYBRID CONSTANT CURRENT LED LAMP

BACKGROUND OF THE INVENTION

1. Field of the Invention This invention relates to a hybrid constant current LED lamp and, more particularly, to a constant current LED lamp having a hybrid driver circuit capable of providing a constant current with a minimal power loss.

2. Description of the Related Art

As the conventional lamp equipments have long suffered from the drawbacks of high power consumption and short service life, LED (light-emitting diodes) for general illumination applications are gaining popularity for their lower power consumption and longer service life.

However, since the LED have to be provided with a driver circuit to convert the AC power of the mains to DC, as the LED are normally driven by DC current, any improvement of the efficiency of the driver circuit would have far reaching effects.

FIG. 1 shows a conventional LED driver circuit, in which a resistor R is connected in series to LED 12. The resistor R is adjusted to consume excess voltage from the power source, so that the LED 12 would receive power with a suitable input current. However, this driver circuit has been shown to exhibit poor conversion efficiency.

FIG. 2 shows another conventional LED driver circuit 1 connected to at least one LED 12 and adapted to receive an AC power VAC. The LED driver circuit 1 is a switching mode power supply, and mainly comprises of a bridge rectifier 10, an electromagnetic interference restraining circuit 11, a filter circuit 16, a high frequency switching circuit 13, a converter circuit 14, and a feedback circuit 15, wherein the bridge rectifier 10 is used to rectify the VAC into a pulsed DC power, while the filter circuit 16 dampens the voltage swings of the DC power. The frequency of the DC power is controlled by the high frequency switching circuit 13, and the converter circuit 14 is used to convert the high voltage into a low voltage DC power that is supplied to the LED 12. The feedback circuit 15 can detect the magnitude of total voltage load of the LED 12, thereby regulates the output voltage of the converter circuit 14.

Although the conventional LED driver circuit 1 does drive the LED 12 to emit light, the architecture of the driver circuit 1 is quite complicated, resulting in a large circuit and high cost. Moreover, the voltage conversion circuit 14 is positioned close to the power input terminal and, as a consequence, a significant amount of electricity tends to lose in the form of heat during voltage conversion, causing a temperature rise in the circuit. This adds up to a lot of wasted energy and reduces the service life of the LED products.

U.S. patent application Ser. No. 13/080,850 discloses another LED driver circuit used to drive multiple LED, or LED packages 12 that comprise multiple chips, connected in series. As shown in FIG. 3, the driver circuit comprises a rectifier circuit 17, a filter circuit 16, a stable voltage circuit 18 and a constant current circuit 19. The rectifier circuit 17 is adapted to receive an alternating current power and converting the alternating current power into a direct current power. The filter circuit 16 is connected to the rectifier circuit 17 and transmits the DC power to the stable voltage circuit 18 and the LED 12, respectively. The stable voltage circuit 18 is connected to the rectifier circuit 17 and comprises a first resistor 181 and a voltage stabilizer 182 (which may by way of example be a Zener diode) connected in series for generating a constant voltage. The constant current circuit 19 is connected to the stable voltage circuit 18, and comprises a transistor 191 connected in series to the LED 12 to limit the driving current flowing into the LED 12 and to maintain the current at a constant value.

Although the conventional LED driver circuit described above is capable of supplying a constant driving current to the LED 12, the transistor 191 is installed to absorb excess voltage from the input AC power. As a result, the excess voltage is absorbed by the transistor 191 and dissipated as waste heat.

SUMMARY OF THE INVENTION

An objective of this invention is to provide a constant current LED lamp and, more particularly, a constant current LED lamp comprising a hybrid driver circuit capable of supplying a constant current with a minimal power loss.

To achieve the objective above, a hybrid constant current LED lamp is disclosed. The LED lamp includes a rectifier unit, a filter circuit, a switching mode power supply, at least one main LED and a subsidiary LED. The rectifier unit is adapted for receiving an alternating current power and converting the alternating current power into a direct current power to its output terminal. The switching mode power supply comprises a primary-side circuit and a secondary-side circuit, wherein the primary-side circuit comprises an input port and a reference voltage port, and wherein the secondary-side circuit comprises a first output port and a second output port. The main LED is electrically connected in series to the output terminal of the rectifier unit and the input port of the primary-side circuit of the switching mode power supply. The subsidiary LED is connected to the secondary-side circuit. Since the main LED is linearly driven, the only DC power loss is the switching loss of the subsidiary LED, the overall efficiency of the circuit is quite high.

DETAILED DESCRIPTION OF THE PREFERRED EMBODIMENTS

The foregoing and other technical characteristics of the present invention will become apparent with the detailed description of the preferred embodiments and the illustration of the related drawings.

Figure 1:
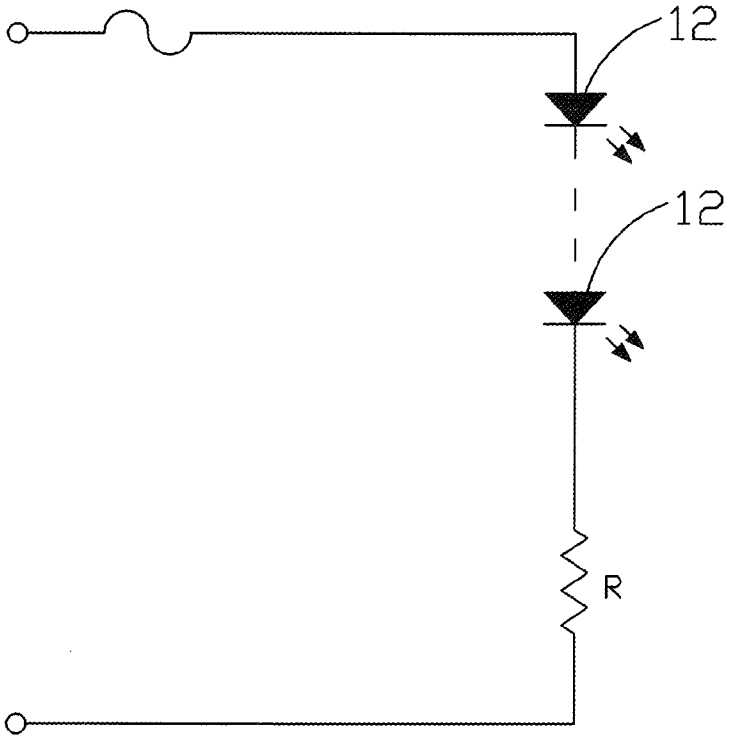
FIG.1 PRIOR ART
FIG. 1 is a schematic diagram of a conventional LED driver circuit.
Figure 2:
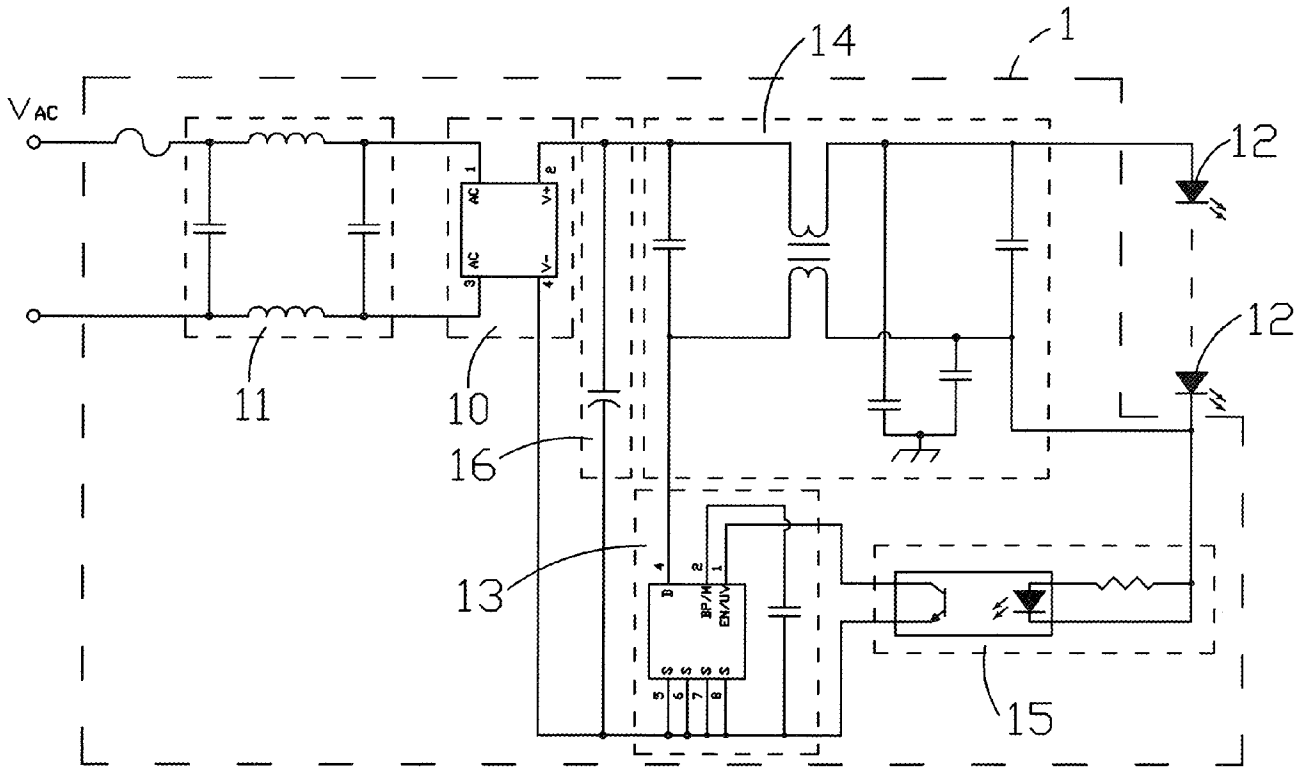
FIG.2 PRIOR ART
FIG. 2 is a schematic diagram of another conventional LED driver circuit.
Figure 3:
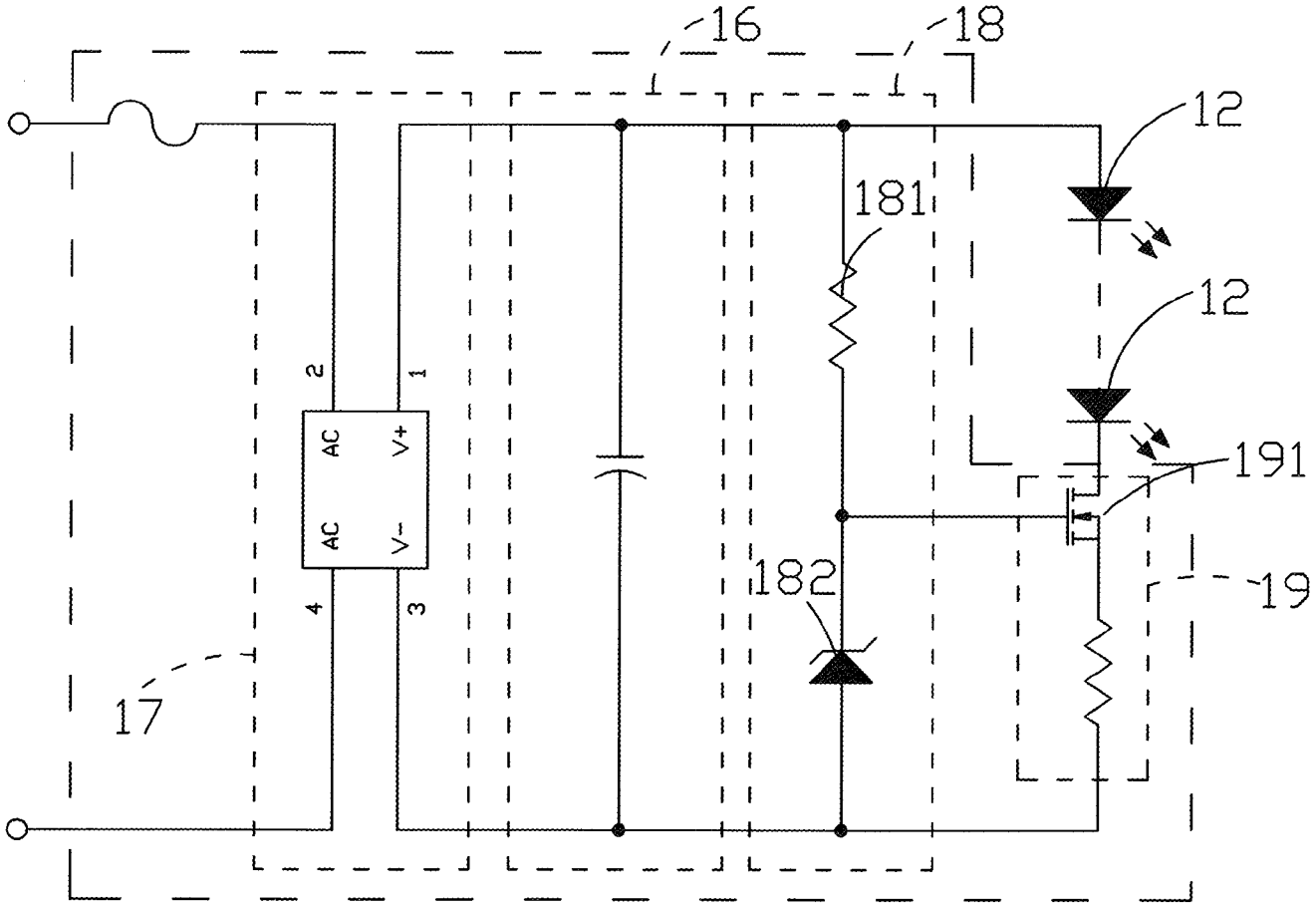
FIG.3 PRIOR ART
FIG. 3 is a schematic diagram of still another conventional LED driver circuit.
Figure 4:
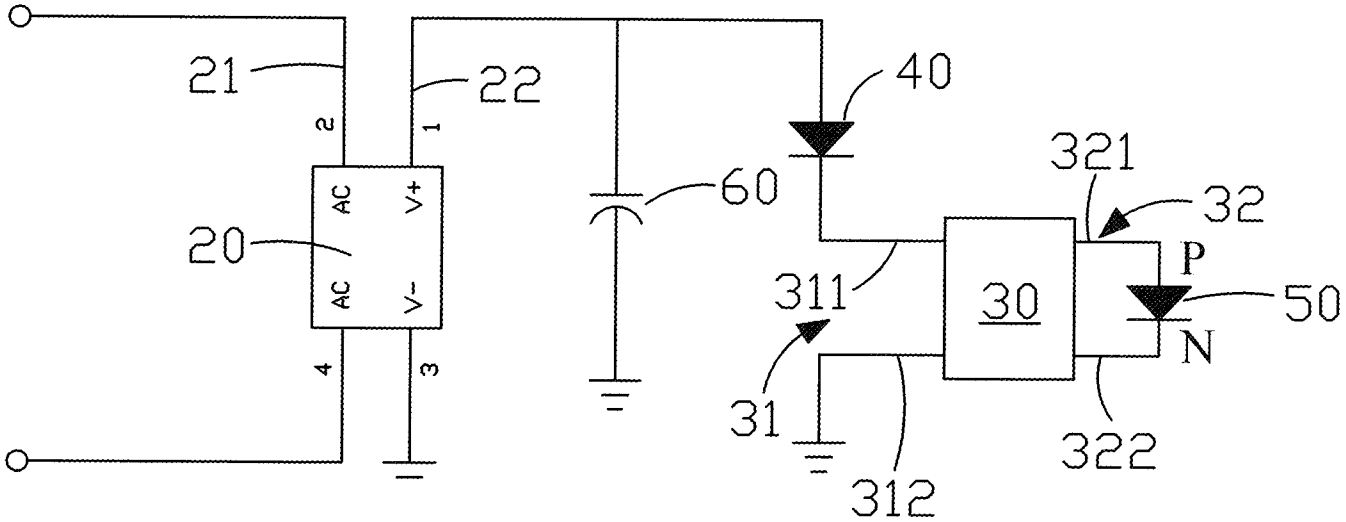
FIG. 4 is a schematic diagram of circuit architecture of the hybrid constant current LED lamp according to the invention.

FIG. 4 shows circuit architecture of the hybrid constant current LED lamp in accordance with the invention. The hybrid constant current LED lamp disclosed herein comprises a rectifier unit 20, a switching mode power supply 30, at least one main light-emitting diode (LED) 40 and a subsidiary light-emitting diode 50.

The rectifier unit 20 includes an input terminal 21 and an output terminal 22. The input terminal 21 is electrically connected to an AC power source, so that the rectifier unit 20 receives the AC power and converts it into a DC power which is in turn output from the output terminal 22. The rectifier unit 20 may by way of example be a bridge rectifier.

The switching mode power supply 30 comprises a primary-side circuit 31 and a secondary-side circuit 32. The primary-side circuit 31 includes an input port 311 and a reference voltage port 312 which is grounded. The secondary-side circuit 32 includes a first output port 321 and a second output port 322. The switching mode power supply 30 is preferably a low-watt power supply selected from, for example, a switching-mode buck power supply, a switching-mode boost power supply, a switching-mode buck-boost power supply and a switching-mode fly back power supply.

The at least one main LED 40 is electrically connected in series to the output terminal 22 of the rectifier unit 20 and the input port 311 of the primary-side circuit 31. The subsidiary LED 50 comprises a positive electrode P connected to the first output port 321 of the secondary-side circuit 32 and a negative electrode N connected to the second output port 322 of the secondary-side circuit 32.

When the driver circuit is under operation, the rectifier unit 20 receives AC power via the input terminal 21 and converts the AC power into a DC power to be output from the output terminal 22. Portion of the voltage output from the output terminal 22 is used to drive the main LED 40 to emit light, whereas the excess voltage is transmitted to the switching mode power supply 30 and then used to drive the subsidiary LED 50 to emit light. The output current (subsidiary LED 50) of the switching mode power supply 30 sets the input current (main LED 40) for a given input voltage.

The present invention further includes a filter unit 60 (which may by way of example be a capacitor) coupled between the output terminal 22 and the main LED 40. The filter unit 60 dampens the voltage swings of the rectified DC power before transmitting the DC power to the main LED 40.

The hybrid constant current LED lamp disclosed herein improves over the prior art and complies with patent application requirements, and thus is duly filed for patent application. While the invention has been described by device of specific embodiments, numerous modifications and variations could be made thereto by those generally skilled in the art without departing from the scope and spirit of the invention set forth in the claims.

What is claimed is:

1. A hybrid constant current LED lamp, comprising:

a rectifier unit for receiving an alternating current power via its input terminal and converting the alternating current power into a direct current power and outputting the direct current power from its output terminal;

a switching mode power supply comprising a primary-side circuit and a secondary-side circuit, wherein the primary-side circuit comprises an input port and a reference voltage port, and wherein the secondary-side circuit comprises a first output port and a second output port;

at least one linearly driven main light-emitting diode electrically connected in series to the output terminal of the rectifier unit and the input port of the primary-side circuit; and a subsidiary light-emitting diode comprising a positive electrode (P) connected to the first output port of the secondary-side circuit and a negative electrode (N) connected to the second output port of the secondary-side circuit, so that the subsidiary light-emitting diode is connected in parallel to the secondary-side circuit, wherein output current of the switching mode power supply sets input current for a given input voltage, and wherein the output current supplied to the subsidiary LED is made constant and the input current flows through the linearly driven main LED is constant, such that the constant current LED lamp having a hybrid driver circuit is capable of providing a constant current.

2. The hybrid constant current LED lamp as recited in claim 1, wherein the rectifier unit is a bridge rectifier.

3. The hybrid constant current LED lamp as recited in claim 1, wherein the reference voltage port of the primary-side circuit is grounded.

4. The hybrid constant current LED lamp as recited in claim 1, wherein the switching mode power supply is a switching-mode buck power supply.

5. The hybrid constant current LED lamp as recited in claim 1, wherein the switching mode power supply is a switching-mode boost power supply.

6. The hybrid constant current LED lamp as recited in claim 1, wherein the switching mode power supply is a switching-mode buck-boost power supply.

7. The hybrid constant current LED lamp as recited in claim 1, wherein the switching mode power supply is a switching-mode fly back power supply.

8. The hybrid constant current LED lamp as recited in claim 1, further comprising a filter unit coupled between the output terminal of the rectifier unit and the main light-emitting diode.

9. The hybrid constant current LED lamp as recited inclaim 8, wherein the filter unit is a capacitor.

* * * * *